United States Patent [19]

Arai et al.

[11] 4,168,743

[45] Sep. 25, 1979

[54] HEAT EXCHANGING WALL AND METHOD FOR THE PRODUCTION THEREOF

[75] Inventors: Nobukatsu Arai, Ibaraki; Kunio Fujie, Tokyo; Kimio Kakizaki, Hitachi, all of Japan

[73] Assignees: Hitachi, Ltd.; Hitachi Cable, Ltd., both of Japan

[21] Appl. No.: 763,084

[22] Filed: Jan. 27, 1977

[30] Foreign Application Priority Data

Feb. 12, 1976 [JP] Japan ..... 51-13206

[51] Int. Cl.[2] ..... F28F 13/18; F28F 19/02; F28F 21/02

[52] U.S. Cl. ..... 165/133; 165/180; 165/DIG. 8

[58] Field of Search ..... 165/133, 180, DIG. 8

[56] References Cited

U.S. PATENT DOCUMENTS

| | | | |
|---|---|---|---|
| 2,887,303 | 5/1959 | Reys | 165/180 |
| 3,079,273 | 2/1963 | Johnson | 165/133 |
| 3,265,124 | 8/1966 | Reys | 165/133 |
| 3,299,949 | 1/1967 | Beurtheret | 165/133 |
| 3,327,777 | 6/1967 | Kovalik et al. | 165/180 |
| 3,399,082 | 8/1968 | Henderson et al. | 165/133 |
| 3,693,711 | 9/1972 | Zygiel | 165/180 |
| 4,044,797 | 8/1977 | Fujie et al. | 165/133 |

FOREIGN PATENT DOCUMENTS

| | | | |
|---|---|---|---|
| 1007863 | 5/1962 | United Kingdom | 165/133 |

OTHER PUBLICATIONS

Natural L51 Process Step to Create Controllable Boiling Centers, E. F. Miersch, IBM Technical Disclosure Bulletin, vol. 18, No. 2, Jul. 1975.

*Primary Examiner*—Sheldon Richter
*Attorney, Agent, or Firm*—Craig and Antonelli

[57] ABSTRACT

A heat exchanging wall including a base member made of a material comprising graphite as its principal component and a resin as a binder, and a thin outer coat member made of similar material as the material for the base member and applied to one surface of the base member. The material for the base member is cast in a mold having a finely ribbed inner wall surface so that the base member may be formed in such one surface thereof with fine linear grooves. Portions of the thin outer coat member corresponding in position to the grooves in such one surface of the base member are formed with a multitude of small apertures. The heat exchanging wall constructed as aforementioned has high corrosion-resistant characteristics and high heat transfer capabilities, so that the wall is resistant to all corrosive fluids.

7 Claims, 2 Drawing Figures

HEAT EXCHANGING WALL AND METHOD FOR THE PRODUCTION THEREOF

BACKGROUND OF THE INVENTION

This invention relates to a heat exchanging wall used for causing acidic or alkaline fluids, fluids containing salts, fluids of organic compounds, etc. to undergo heat exchange with fluids of the same or different type, such heat exchanging wall having particular utility for use in heat exchangers for chemical plants and other facilities.

Heretofore, a number of methods have been used in heat exchangers for chemical plants and other facilities for preventing corrosion of the heat exchangers. In one method, the heat exchanging wall (heat transfer tubing) is made of a metal which is resistant to corrosion by a fluid that flows through the tubing. In another method, the surface of the wall made of a metal which is not resistant to corrosion by the fluid is coated with a layer of metallic material or plastics which is highly resistant to corrosion by the fluid. In a further method, graphite of high corrosion-resistance is selected as a material for the heat transfer tubing.

Some disadvantages are associated with the aforementioned methods of the prior art. Coating of the wall surface with a metallic material of high corrosion-resistance increases cost for production of the heat exchanging wall. Moreoever, when a coat of metallic material is applied to the wall surface, there are such defects as the development of a lack of continuation or openings and crack formation. Meanwhile, when a coat of plastics is applied, the problem of peeling off, swelling or cracking of the coat is encountered. Such being the case, coating of the wall surface with a metallic or plastic material does not provide a completely reliable solution to the problems of corrosion of the heat exchanging wall. Furthermore, when graphite is used as material for the heat exchanging wall, difficulty is experienced in improving the heat exchanging (heat transfer) efficiency by forming elevated and depressed areas of a complex pattern on the wall surface due to low mechanical strength of the metal.

SUMMARY OF THE INVENTION

An object of this invention is to provide a heat exchanging wall which is resistant to all the corrosive fluids.

Another object is to provide a heat exchanging wall which has superb heat transfer capabilities.

According to the invention, there is provided a heat exchanging wall including a base member made of a material comprising 60 to 90% by weight graphite and a 40 to 10% by weight resin selected from the group consisting of a phenol resin, an epoxy resin and a furan resin and serving as a binder, and a thin outer coat member made of a material comprising 30 to 90% by weight graphite and a 70 to 10% by weight resin selected from the group consisting of a phenol resin, an epoxy resin and a furan resin and serving as a binder, such base member being formed in one surface thereof with fine linear grooves and such thin outer coat member being applied to the grooved surface of the base member and formed with a multitude of small apertures in portions thereof which correspond in position to the grooves in the base member.

According to the invention, there is also provided a method of production of a heat exchanging wall which is characterized by comprising the steps of mixing a 40 to 10% by weight resin selected from the group consisting of a phenol resin, an epoxy resin and a furan resin with 60 to 90% by weight graphite and adding to the mixture alcohol in an amount which is 0.5 to 2.0 times the weight of the resin to provide a base member material, pouring such base member material in a split mold having fine ribs projecting from one inner surface to provide a base member formed in one surface thereof with fine linear grooves, applying on the grooved surface of the base member a thin outer coat member made of a material similar to the base member material, and forming a multitude of small apertures in portions of the outer coat member which correspond in position to the grooves in the base member.

DESCRIPTION OF THE PREFERRED EMBODIMENT

Figure 1:
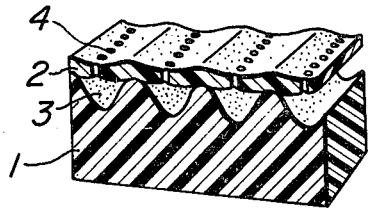
FIG. 1 is a sectional view of the heat exchanging wall according to this invention.

In FIG. 1, the heat exchanging wall is shown as including a base member 1, and an outer coat member 2 applied to the base member 1. The base member 1 is made of a material comprising 60 to 90% by weight graphite and a 40 to 10% by weight resin selected from the group consisting of a phenol resin, an epoxy resin and a furan resin and serving as a binder. The base member 1 is formed in one surface thereof with fine linear grooves 3 having a depth in the range between 0.6 and 1.2 mm and spaced apart from one another a distance in the range between 0.4 and 1.0 mm.

The outer coat member 2, which is made of a material similar to the material for the base member 1, may include a slightly greater amount of resin than the base member 1. More specifically, the outer coat member 2 may be made of material comprising 30 to 90% by weight graphite and a 70 to 10% by weight resin selected from the group consisting of a phenol resin, an epoxy resin and a furan resin, and has a thickness in the range between 0.3 and 1.2 mm. Small apertures 4 are formed in large numbers in portions of the outer coat member 2 which correspond in position to the grooves 3 in the base member 1.

The heat exchanging wall of the aforementioned construction can be produced by a process which will be described hereinafter. A 40 to 10% by weight resin is mixed with 60 to 90% by weight graphite in particulate form, and the mixture is added with alcohol in an amount which is 0.5 to 2.0 times the weight of the resin to provide a base member material of a suitable fluidity. The base member material thus obtained is poured in a mold for forming by casting a wall base member which mold is formed on its inner wall surface with ribs corresponding in size and position to grooves which are desired to be formed in the base member of the wall. This enables grooves of a desired size and number to be formed in one surface of the base member without resorting to machining. The base member produced in this way contains no alcohol because the alcohol added to the material immediately vaporizes after the base member is produced.

A material for the outer coat member 2 may contain a resin in a slightly greater amount than a material for the base member 1 depending on circumstances. For example, a 70 to 10% by weight resin is mixed with 30 to 90% by weight graphite, and the mixture is added with alcohol which is in the same amount as described with reference to the production of the base member of the wall. This produces a material for the outer coat member of a suitable fluidity which is formed into a thin sheet form and applied to the grooved surface of the base member 1. No bonding agent need be used in applying the outer coat member material to the base member material because the two materials have suitable tackiness. Thereafter, an aperture forming machine, such as a rotor having small needles attached to its outer periphery, is used to form apertures in the outer coat member.

EXAMPLE

An example will be described in which a heat transfer tubing having the heat exchanging wall of the aformentioned construction was produced. A mixture of 80% by weight graphite and a 20% by weight phenol resin was added with ethyl alcohol in an amount which is 0.7 time the weight of the resin, and the mixture was kneaded. The material was poured in a split mold which has on its inner wall surface a spiral rib of 0.7 mm in height and having convolutions spaced from one another a distance of 0.6 mm, to provide an inner core tube member 10. The inner core tube member 10 had an outer diameter of 14 mm and an inner diameter of 10 mm, and was formed in its outer surface with a spiral groove 30.

Figure 2:
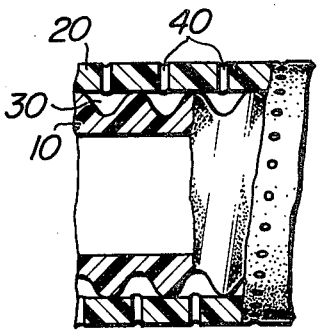
FIG. 2 is a sectional view of the heat exchanging wall according to the invention as applied to a heat transfer tubing.

Then a mixture of 60% by weight graphite and a 40% by weight phenol resin was added with ethyl alcohol in an amount which is 0.7 time the weight of the resin, and the mixtures was kneaded. By extrusion through a slit, the material was made into an outer coat member 20 of 0.5 mm thick which was applied to the outer periphery of the inner core tube member 10. Thereafter, before the outer coat member 20 completely set, a rotor provided on its outer periphery with a multitude of small needles was moved along the coat member 20 to form a multitude of small apertures 40 in portions of the outer coat member 20 which correspond in position to the spiral groove 30 formed in the outer surface of the inner core tube member 10. What resulted was a heat transfer tubing, shown in FIG. 2, which has high corrosion-resistant characteristics and high heat transfer capabilities.

From the foregoing description, it will be appreciated that the heat exchanging wall in accordance with this invention is highly resistant to corrosion by acidic or alkaline fluids, fluids containing salts and fluids of organic compounds, so that the heat exchanging wall according to the invention has particular utility for use in heat exchangers for causing such fluids to undergo heat exchange with fluids of the same or different type and can achieve heat transfer with a high degree of efficiency.

An added advantage is that the heat exchanging wall according to the invention can be readily produced because no machining of the base member is required and the wall can be produced only by casting a suitable material in a mold.

What we claim is:

1. A heat exchanging wall comprising a molded base member made of a material containing 60 to 90% by weight graphite and 40 to 10% by weight of a resin as a binder, said base member being molded with fine linear grooves in one surface thereof; and a thin outer coat member made of a material comprising 30 to 90% by weight graphite and 70 to 10% by weight of said resin and being bonded to the grooved surface of said base member, said outer coat member having a multitude of small apertures in portions thereof which correspond in position to the grooves in said base member; said base member and said thin outer coat member being bonded cohesively together by said binder resin.

2. A heat exchanging wall as claimed in claim 1, wherein said resin is selected from the group consisting of a phenol resin, an epoxy resin and a furan resin.

3. A heat exchanging wall as claimed in claim 1, wherein said thin outer coat member is bonded to the base member at ridged portions formed between the fine linear grooves.

4. A heat exchanging wall as claimed in claim 1, wherein said fine linear grooves have a depth in the range between 0.6 and 1.2 mm. and are spaced apart from one another a distance in the range between 0.4 and 1.0 mm.

5. A heat exchanging wall as claimed in claim 4, wherein said small apertures have a diameter that is smaller than the distance between said grooves and the outer coat member has a thickness in the range between 0.3 and 1.2 mm.

6. A heat exchanging wall as claimed in claim 1, wherein said base member is in the form of an inner core tube member and said fine linear grooves are formed in said tube member by a spiral rib, the outer coat member being in the form of a cylinder which is bonded to the outer periphery of the inner core tube member.

7. A heat exchanging wall as claimed in claim 1, wherein said multitude of small apertures is arranged in rows overlying the grooves within of said base member, said apertures being shaped by a plurality of needles penetrating through the outer coating member before said member has completely set.

* * * * *